US011804663B2

(12) United States Patent
Kitaoka et al.

(10) Patent No.: US 11,804,663 B2
(45) Date of Patent: Oct. 31, 2023

(54) CONNECTOR AND CONNECTOR CONNECTION STRUCTURE

(71) Applicants: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

(72) Inventors: Kenichi Kitaoka, Mie (JP); Junichi Mukuno, Mie (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 209 days.

(21) Appl. No.: 17/423,443

(22) PCT Filed: Jan. 16, 2020

(86) PCT No.: PCT/JP2020/001268
§ 371 (c)(1),
(2) Date: Jul. 15, 2021

(87) PCT Pub. No.: WO2020/158412
PCT Pub. Date: Aug. 6, 2020

(65) Prior Publication Data

US 2022/0094085 A1 Mar. 24, 2022

(30) Foreign Application Priority Data

Jan. 31, 2019 (JP) ..... 2019-015670

(51) Int. Cl.
*H01R 9/11* (2006.01)
*H01R 4/30* (2006.01)
(Continued)

(52) U.S. Cl.
CPC ..... *H01R 9/11* (2013.01); *H01R 4/308* (2013.01); *H01R 9/223* (2013.01); *H01R 11/05* (2013.01); *H01R 11/12* (2013.01); *H01R 2201/26* (2013.01)

(58) Field of Classification Search
CPC ..... H01R 9/11; H01R 4/308; H01R 9/223; H01R 11/12
See application file for complete search history.

(56) References Cited

U.S. PATENT DOCUMENTS 9,059,534 B2 * 6/2015 Endo ..... H01R 13/5205
9,147,952 B2 * 9/2015 Kikuchi ..... H01R 12/7082
(Continued)

FOREIGN PATENT DOCUMENTS

JP 2012-204084 A 10/2012
JP 2013-084429 A 5/2013
(Continued)

OTHER PUBLICATIONS

International Search Report dated Mar. 3, 2020 for WO 2020/158412 A1 (5 pages).

*Primary Examiner* — Phuong Chi Thi Nguyen
(74) *Attorney, Agent, or Firm* — Venjuris, P.C.

(57) ABSTRACT

A connector 10 includes two connection terminals 30 to be respectively connected to ends of two wires 20 extending side by side and having through holes in tip parts, and a housing 70 for accommodating the two connection terminals 30 separated from each other with the respective tip parts caused to project out. The tip parts of the two connection terminals 30 are overlapped each other while being spaced
(Continued)

apart in an orthogonal direction Z, and the through holes of the two connection terminals 30 are located on the same axis along the orthogonal direction Z.

5 Claims, 6 Drawing Sheets

(51) Int. Cl.

| | |
|---|---|
| *H01R 9/22* | (2006.01) |
| *H01R 11/05* | (2006.01) |
| *H01R 11/12* | (2006.01) |

(56) References Cited

U.S. PATENT DOCUMENTS

| | | | | |
|---|---|---|---|---|
| 9,728,891 | B2 * | 8/2017 | Casses | H02G 15/007 |
| 10,312,612 | B2 * | 6/2019 | Ho | H01R 12/71 |
| 11,063,380 | B2 * | 7/2021 | Wu | H01R 12/737 |
| 11,456,560 | B2 * | 9/2022 | Masuda | H01R 13/5202 |
| 2012/0238138 | A1 | 9/2012 | Matsuoka et al. | |
| 2014/0322965 | A1 | 10/2014 | Kuji et al. | |

FOREIGN PATENT DOCUMENTS

| | | | |
|---|---|---|---|
| JP | 2015-005432 | A | 1/2015 |
| JP | 2016-213046 | A | 12/2016 |
| JP | 2016-213114 | A | 12/2016 |
| WO | 2014/181841 | A1 | 11/2014 |

* cited by examiner

CONNECTOR AND CONNECTOR CONNECTION STRUCTURE

CROSS REFERENCE TO RELATED APPLICATIONS

This application is a national phase of PCT application No. PCT/JP2020/001268, filed on 16 Jan. 2020, which claims priority from Japanese patent application No. 2019-015670, filed on 31 Jan. 2019, all of which are incorporated herein by reference.

TECHNICAL FIELD

The present invention relates to a connector and a connector connection structure.

BACKGROUND

Patent Document 1 discloses a connector to be connected to a device of a vehicle. The connector described in Patent Document 1 includes two L-shaped terminals respectively connected to ends of two wires, a separate housing into which the both wires are inserted and which includes a service hole used to mount the both L-shaped terminals from front, and a service cover for closing the service hole.

In the case of connecting the above connector to the device, the two wires connected to the L-shaped terminals are inserted into the separate housing and the two L-shaped terminals are arranged in the service hole. Subsequently, the service hole is closed by the service cover and tip parts of the two L-shaped terminals are caused to project from the service cover. Then, bolts are inserted through bolt holes formed in the tip parts of the two L-shaped terminals and respectively fastened to the device, whereby the connector is connected to the device.

PRIOR ART DOCUMENT

Patent Document

Patent Document 1: JP 2015-005432 A

SUMMARY OF THE INVENTION

Problems to be Solved

In connecting the above connector to the device, the two L-shaped terminals need to be individually fastened to the device. Thus, it takes time and labor.

An object of the present invention is to provide a connector and a connector connection structure which facilitate a connecting operation to a device.

Means to Solve the Problem

A connector for achieving the above object is provided with a plurality of connection terminals to be respectively connected to ends of a plurality of wires extending side by side, the plurality of connection terminals including through holes in tip parts, and a housing for accommodating the plurality of connection terminals separated from each other with the respective tip parts caused to project out, wherein the tip parts of the plurality of connection terminals are located at a distance from each other in an orthogonal direction orthogonal to both an arrangement direction of the wires and an extending direction of the tip parts, and the through holes of the plurality of connection terminals are located on the same axis along the orthogonal direction.

According to this configuration, the plurality of connection terminals are separated from each other, and the through holes in the tip parts of the plurality of connection terminals are located on the same axis along the orthogonal direction. Thus, when the plurality of connection terminals are bolted to a device, to which the connector is connected, the plurality of connection terminals can be collectively fastened by inserting a common bolt into the through holes of the plurality of connection terminals. Therefore, a connecting operation to the device is facilitated.

In the above connector, preferably, the plurality of connection terminals include a first connection terminal and a second connection terminal, the first and second connection terminals include a first base-end side terminal and a second base-end side terminal to be connected to the ends of the wires and extending along the extending direction of the ends and a first tip side terminal and a second tip side terminal formed with the through holes and to be mounted on the first and second base-end side terminals, and the first and second tip side terminals have the same shape and are inverted from each other.

According to this configuration, the first tip side terminal of the first connection terminal and the second tip side terminal of the second connection terminal have the same shape and are inverted from each other. Thus, common components can be used as the first and second tip side terminals. Therefore, an increase in the number of components of the connector can be suppressed.

In the above connector, preferably, the plurality of connection terminals are provided with locking holes, and a plurality of locking projections to be respectively locked into the locking holes of the plurality of connection terminals project inside the housing.

According to this configuration, since the connection terminals can be locked in the housing, an operation at the time of manufacturing the connector is facilitated.

Further, a connector connection structure for achieving the above object is provided with any one of the above connectors and a device including a plurality of connecting members to be electrically connected to the plurality of connection terminals, the plurality of connection terminals and the plurality of connecting members being collectively fastened by one bolt.

According to this configuration, functions and effects similar to those of any one of the above connectors can be achieved.

In the above connector connection structure, preferably, the bolt is conductive, the connection terminals and the plurality of connecting members come into contact with and are conductively connected to each other in the orthogonal direction to form a plurality of conductive portions, and a first insulator made of insulating ceramic is interposed between the plurality of conductive portions in the orthogonal direction, and a second insulator made of insulating ceramic is interposed between the outermost conductive portion in the orthogonal direction, out of the plurality of conductive portions, and a head portion of the bolt.

According to this configuration, the plurality of conductive portions are insulated from each other by the first insulator and the outermost conductive portion in the orthogonal direction and the head portion of the bolt are insulated from each other by the second insulator. Here, since being made of ceramic, each insulator is hardly deformed by a fastening force at the time of fastening the bolt. As the bolt is fastened, a pressing force is applied to each conductive portion in the orthogonal direction by the adjacent insulator. This makes a conductive state of each conductive portion satisfactory. Therefore, the plurality of conductive portions can be collectively and suitably fastened by the bolt while insulation between the plurality of conductive portions is ensured.

Effect of the Invention

According to the present invention, an increase in man-hours at the time of connector connection can be suppressed.

BRIEF DESCRIPTION OF THE DRAWINGS

FIGS. 3A and 3B are perspective views showing wires and connection terminals of the embodiment, wherein FIG. 3A is a perspective view from front and FIG. 3B is a perspective view from behind.

DETAILED DESCRIPTION TO EXECUTE THE INVENTION

Figure 1:
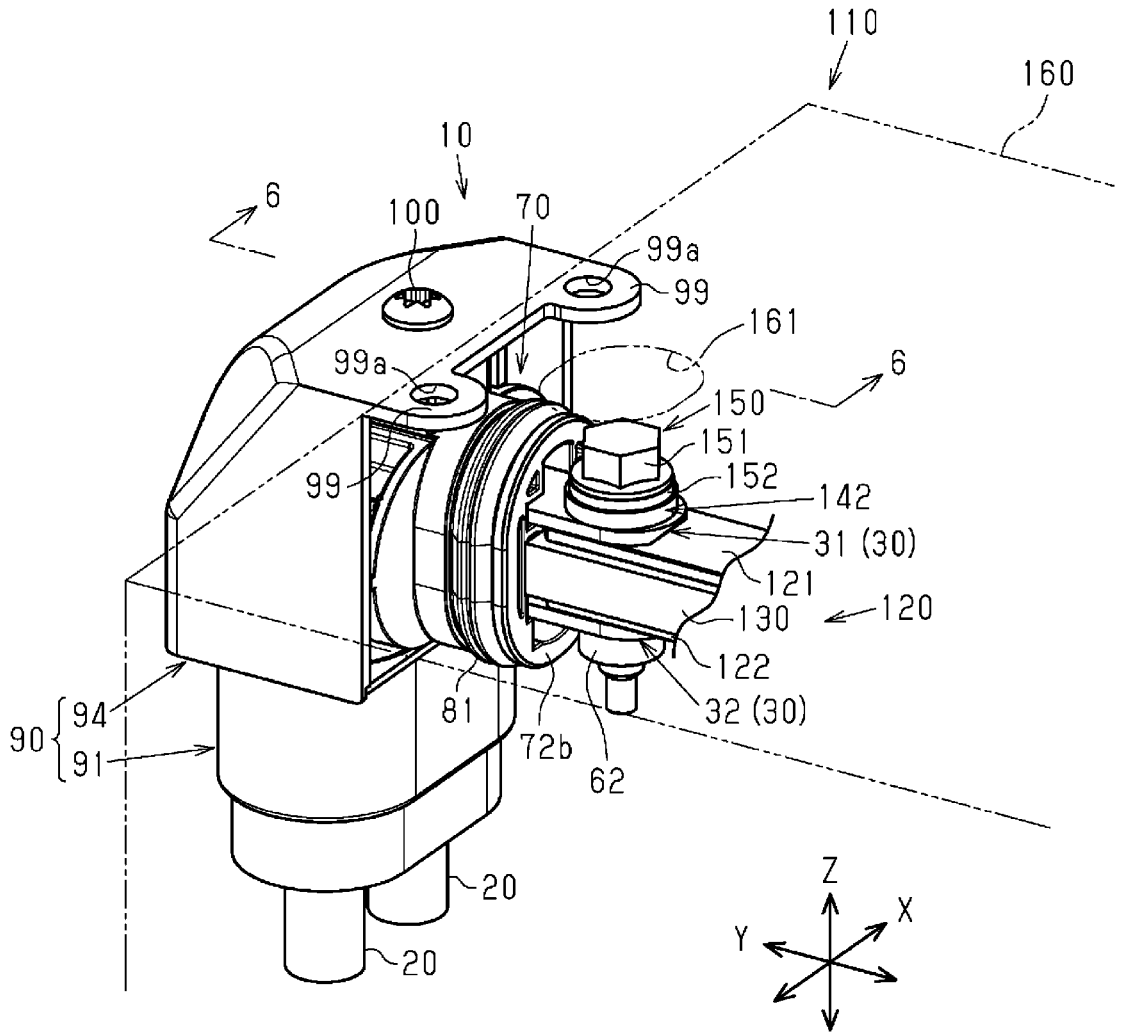
FIG. 1 is a perspective view showing a state where a connector and a device are connected in one embodiment of a connector connection structure.

Hereinafter, one embodiment is described with reference to FIGS. 1 to 7.

As shown in FIGS. 1 to 3B, a connector 10 includes connection terminals 30 to be respectively connected to ends 21 of two wires 20 extending side by side and a housing 70 for accommodating these connection terminals 30 separated from each other with tip parts of the connection terminals 30 projecting out. Note that an arrangement direction of the twire 20 and an extending direction of the tip parts of the connection terminals 30 are orthogonal.

In the following description, the arrangement direction of the wires 20, the extending direction of the tip parts of the connection terminals 30 and a direction orthogonal to both the arrangement direction and the extending direction are referred to as an arrangement direction X, an extending direction Y and an orthogonal direction Z.

In this embodiment, each connection terminal 30 of the connector 10 is, for example, electrically connected to a terminal block 120 of a device 110 to be installed in a vehicle.

First, the configuration of the connector 10 is described.

<Connection Terminals 30>

Figure 3A:
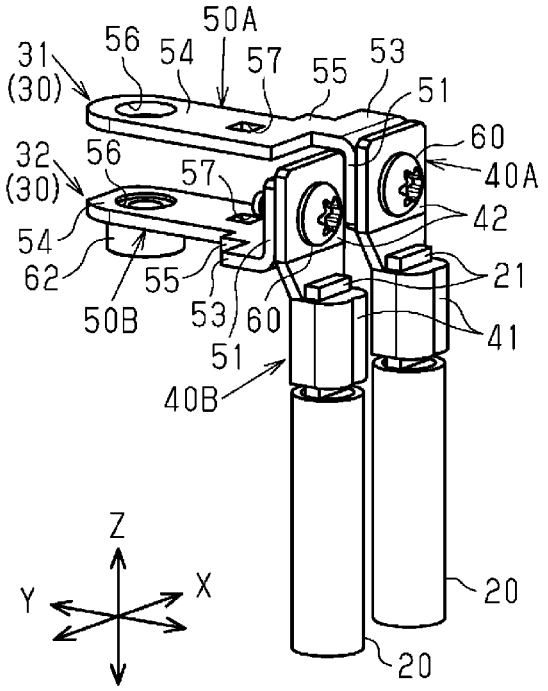
Figure 3B:
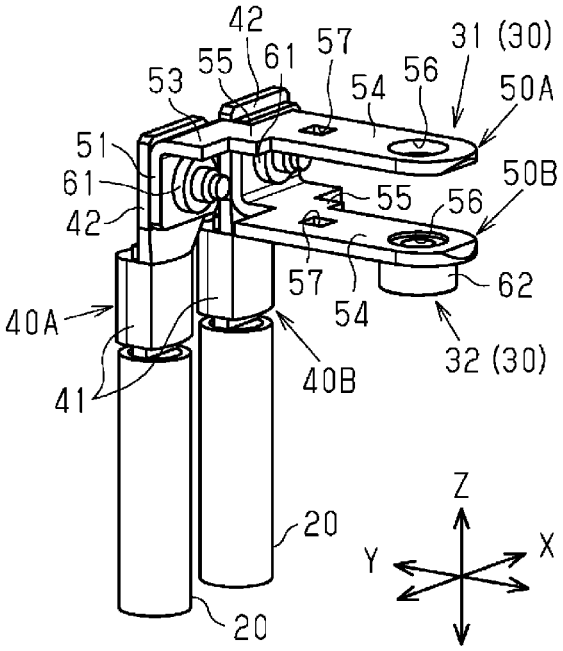

As shown in FIGS. 3A and 3B, the connection terminals 30 include a first connection terminal 31 to be connected to the end 21 of one of the two wires 20, and a second connection terminal 32 to be connected to the end 21 of the other wire 20. Each connection terminal 31, 32 is formed by press-working a metal material such as copper, copper alloy, aluminum or aluminum alloy.

First, the first connection terminal 31 is described.

The first connection terminal 31 includes a first base-end side terminal 40A to be connected to the end 21 of the wire 20 and extending along an extending direction of the end 21 (orthogonal direction Z), and a first tip side terminal 50A to be mounted on the first base-end side terminal 40A by a screw 60.

The first base-end side terminal 40A includes a crimping portion 41 to be crimped to the end 21 of the wire 20 and a plate-like base end-side extending portion 42 extending from the crimping portion 41. The base-end side extending portion 42 is formed with a through hole 43 (see FIG. 5).

The first tip side terminal 50A includes a fixing portion 51 to be fixed to the base-end side extending portion 42 of the first base-end side terminal 40A, a bent portion 53 bent from the fixing portion 51 and a tip side extending portion 54 extending along the extending direction Y from one side in the arrangement direction X of the bent portion 53.

Figure 5:
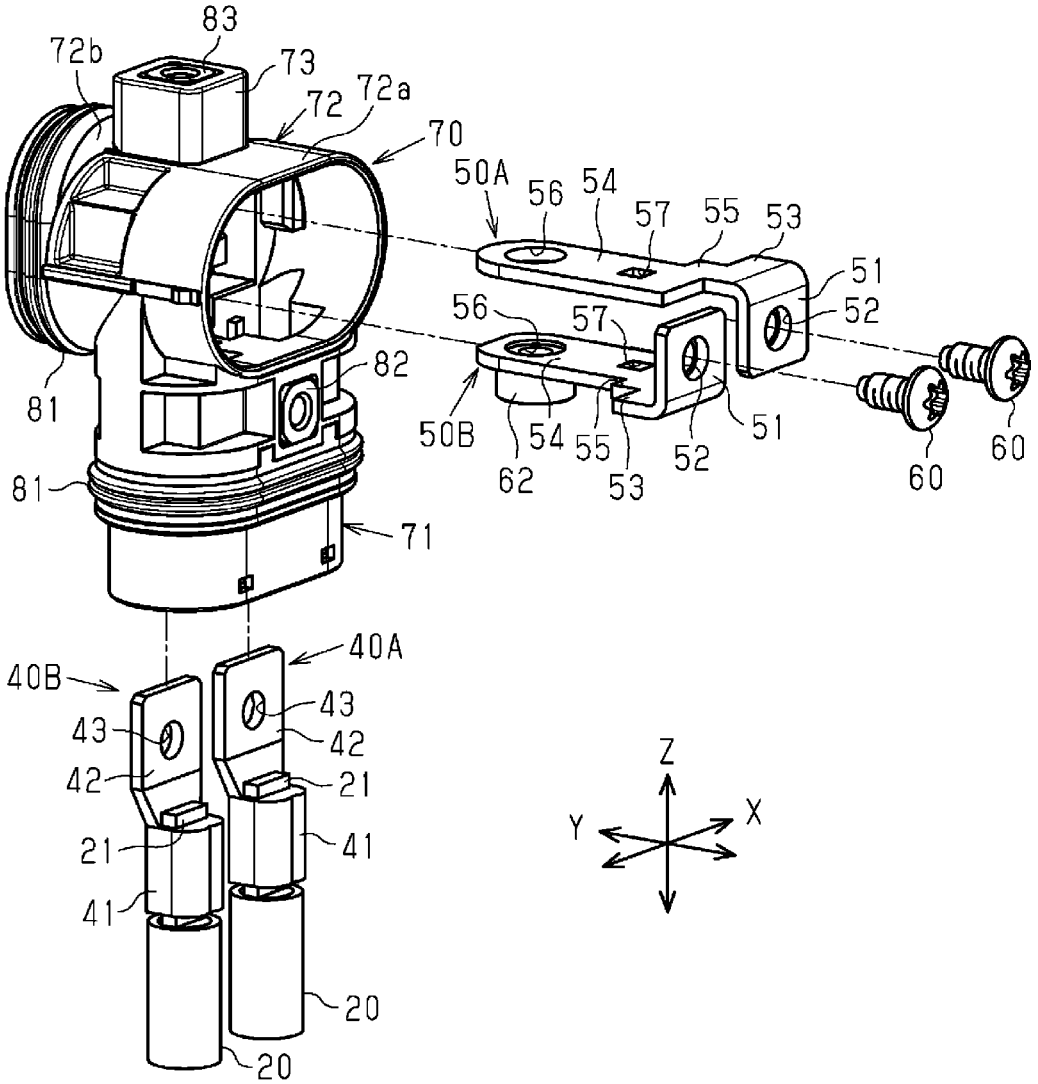
FIG. 5 is an exploded perspective view showing the housing, base-end side terminals and tip side terminals separated from each other in the connector of the embodiment.

The fixing portion 51 is formed with a through hole 52 (see FIG. 5). As shown in FIG. 3B, a nut 61 is joined to a surface of the fixing portion 51 opposite to the base-end side extending portion 42. The nut 61 is located on the same axis as the through hole 52.

With the base-end side extending portion 42 and the fixing portion 51 overlapped, the screw 60 is inserted through the through holes 43, 52 and threadably engaged with the nut 61, whereby the first base-end side terminal 40A and the first tip side terminal 50A are mounted to each other.

A corner portion 55 continuous with a side edge of the bent portion 53 and a side edge of the tip side extending portion 54 is formed in a coupling part of the bent portion 53 and the tip side extending portion 54.

A through hole 56 is formed in a tip part of the tip side extending portion 54. A locking hole 57 is formed in a base end part of the tip side extending portion 54.

Next, the second connection terminal 32 is described.

The second connection terminal 32 includes a second base-end side terminal 40B having the same shape as the first base-end side terminal 40A and a second tip side terminal SOB to be mounted on the second base-end side terminal 40B by a screw 60 and having the same shape as the first tip side terminal 50A. The second tip side terminal SOB is mounted on the second base-end side terminal 40B by the screw 60 and a nut 61 in such a posture inverted with respect to the first tip side terminal 50A in the orthogonal direction Z.

From the above, components of the second base-end side terminal 40B and the second tip side terminal SOB are denoted by the same reference signs as those of the first base-end side terminal 40A and the first tip side terminal 50A to omit repeated description.

A nut 62 is joined to a part of a tip part of the second tip side terminal SOB on a side opposite to a side where a fixing portion 51 projects. More particularly, a part of the nut 62 is press-fit into a through hole 56 of a tip side extending portion 54. The nut 62 is located on the same axis of a through hole 56.

Here, as described above, the first and second tip side terminals 50A, SOB have the same shape and are inverted from each other. Thus, the tip parts of the both tip side extending portions 54 are located at a distance from each other in the orthogonal direction Z. The through holes 56 of the both tip side extending portions 54 are located on the same axis along the orthogonal direction Z. Similarly, the locking holes 57 of the both tip side extending portions 54 are located on the same axis along the orthogonal direction Z.

<Housing 70>

Figure 2:
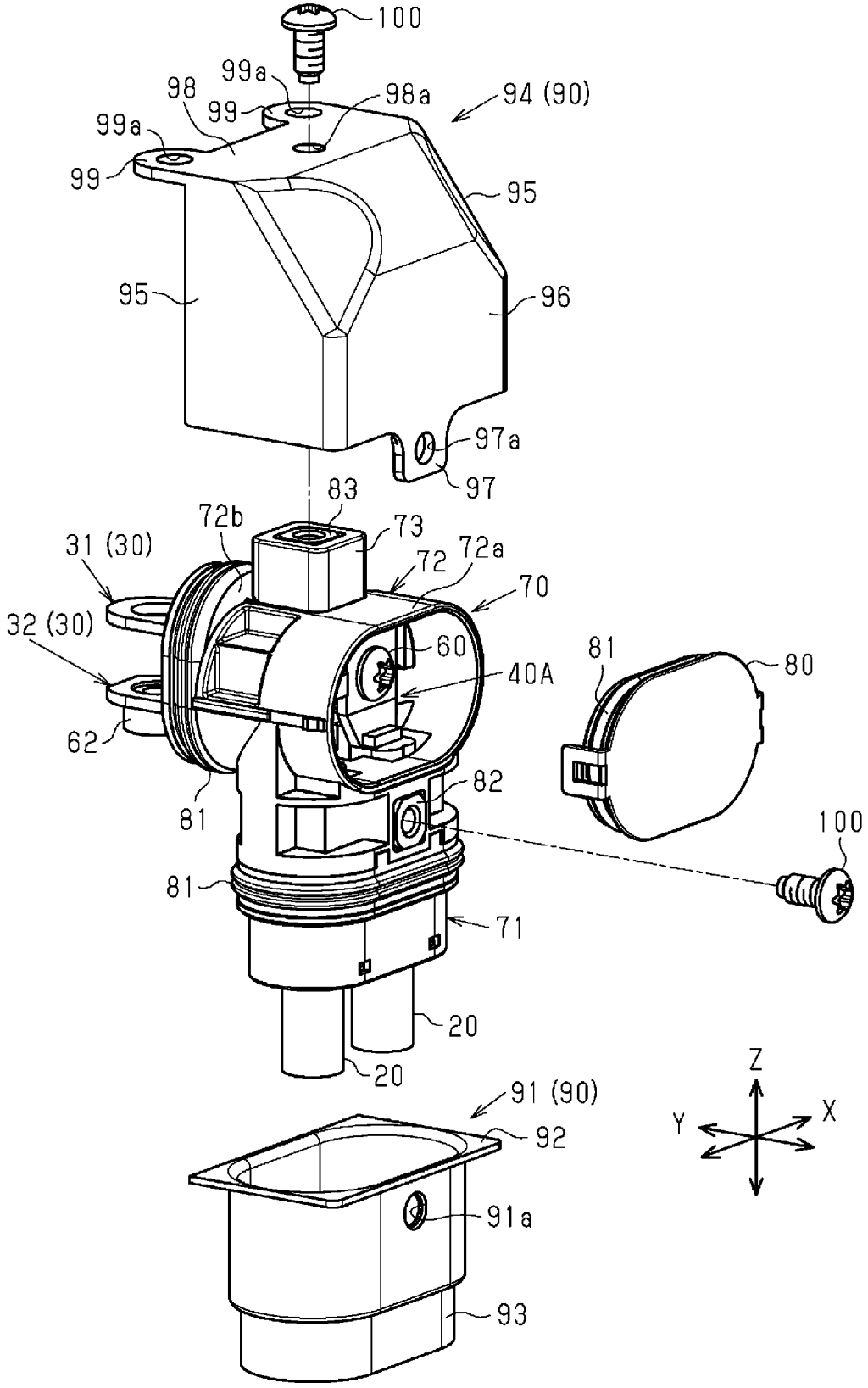
FIG. 2 is an exploded perspective view showing a housing, a cap, a first shield shell and a second shield shell separated from each other in the connector of the embodiment.
Figure 4:
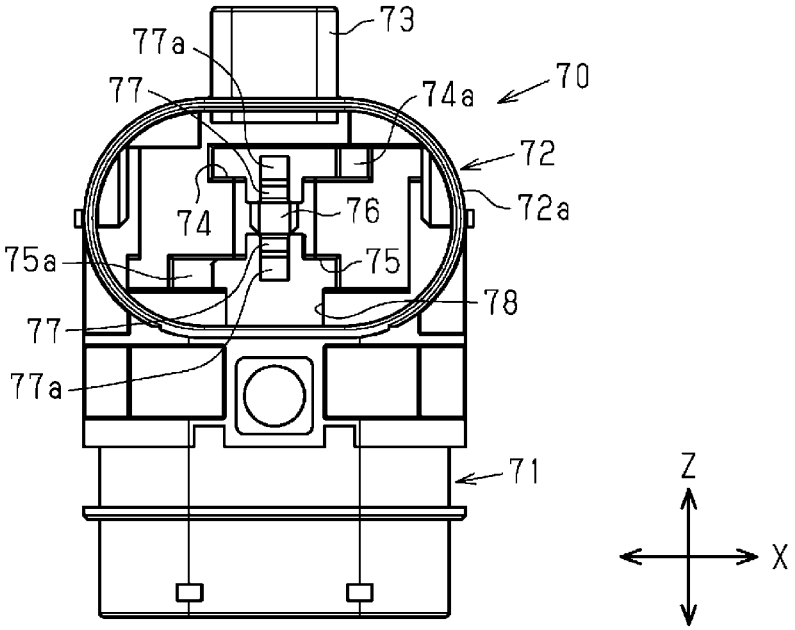
FIG. 4 is a front view of the housing of the embodiment viewed from the side of an insertion opening.

As shown in FIGS. 2, 4 and 5, the housing 70 is made of a resin material and includes a tubular insertion portion 71 into which the plurality of wires 20 are individually inserted along the orthogonal direction Z and a tubular connecting portion 72 communicating with one end of the insertion portion 71 and open on both sides in the extending direction Y.

The insertion portion 71 has an oval outer shape long in the arrangement direction X. An annular groove is formed in the outer peripheral surface of the insertion portion 71. An annular sealing member 81 is provided in this annular groove. An internally threaded insert member 82 is embedded in a part of the insertion portion 71 on one side (right side of FIG. 2) in the extending direction Y and between the sealing member 81 and the connecting portion 72 (see FIGS. 2 and 5).

Figure 6:
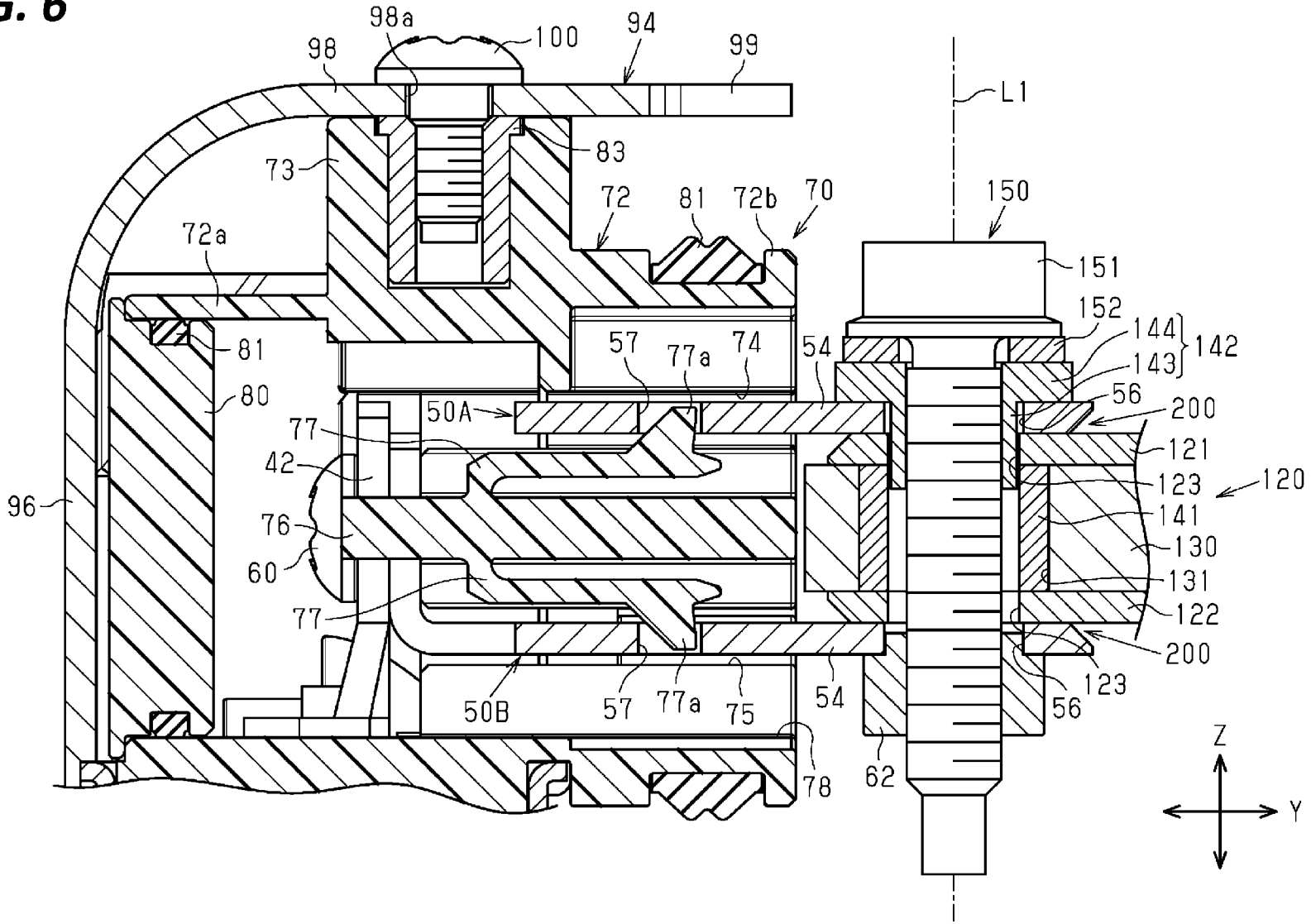
FIG. 6 is a section along 6-6 of FIG. 1.

As shown in FIGS. 2, 5 and 6, an opening of the connecting portion 72 on one side in the extending direction Y serves as an insertion opening 72*a* through which the both tip side terminals 50A, 50B are inserted. Further, an opening of the connecting portion 72 on the other side in the extending direction Y serves as a projection opening 72*b* for causing the tip parts of the both connection terminals 31, 32 to project. The insertion opening 72*a* has an oval outer shape long in the arrangement direction X. The projection opening 72*b* has an oval outer shape long in the orthogonal direction Z.

As shown in FIGS. 2 and 6, a cap 80 made of a resin material is fit into the insertion opening 72*a*. An annular groove is formed in the outer peripheral surface of the cap 80. A sealing member 81 is provided in this annular groove.

Further, as shown in FIGS. 1, 2 and 5 to 7, a sealing member 81 is provided on the outer peripheral surface of the projection opening 72*b*.

As shown in FIGS. 2 and 4 to 6, a projecting portion 73 projecting in the orthogonal direction Z is formed on a part of the connecting portion 72 opposite to the insertion portion 71. An internally threaded insert member 83 is embedded in the projecting portion 73 (see FIGS. 2 and 5).

As shown in FIGS. 4 and 6, a first accommodating portion 74 and a second accommodating portion 75 for respectively individually accommodating the first connection terminal 31 and the second connection terminal 32 are provided side by side in the orthogonal direction Z inside the connecting portion 72. The first and second accommodating portions 74, 75 are partitioned by a separation wall 76. The respective accommodating portions 74, 75 penetrate in the extending direction Y. Note that a width in the orthogonal direction Z of each accommodating portion 74, 75 is slightly larger than a width in the orthogonal direction Z of each connection terminal 31, 32, i.e. a thickness of each connection terminal 31, 32. In this way, tolerances between the respective connection terminals 31, 32 and the respective accommodating portions 74, 75 can be absorbed.

As shown in FIG. 4, a first contact portion 74*a* with which the corner portion 55 of the first tip side terminal 50A comes into contact from one side in the extending direction Y when the first tip side terminal 50A is inserted into the first accommodating portion 74 is formed on a wall part of the first accommodating portion 74 on the other side (right side of FIG. 4) in the arrangement direction X. Similarly, a second contact portion 75*a* with which the corner portion 55 of the second tip side terminal 50B comes into contact from the one side in the extending direction Y when the second tip side terminal 50B is inserted into the second accommodating portion 75 is formed on a wall part of the second accommodating portion 75 on one side (left side of FIG. 4) in the arrangement direction X. Movements of the first and second tip side terminals 50A, 50B toward the other side in the extending direction Y are restricted by these contact portions 74*a*, 75*a*.

As shown in FIGS. 4 and 6, a pair of arm portions 77 are provided to project on both sides in the orthogonal direction Z of the separation wall 76. Each arm portion 77 is cantilevered from one side toward the other side in the extending direction Y. Locking projections 77*a* lockable into the respective locking holes 57 of the first and second tip side terminals 50A, 50B are formed on tip parts of the respective arm portions 77. By locking each locking projection 77*a* into each locking hole 57, movements of the first and second tip side terminals 50A, 50B toward the one side in the extending direction Y are restricted.

An escaping portion 78 penetrating in the extending direction Y is formed to be continuous with a part of the second accommodating portion 75 opposite to the first accommodating portion 74. The escaping portion 78 functions as an escaping space for allowing the nut 62 to escape when the second tip side terminal 50B is inserted into the second accommodating portion 75.

The connection terminals 31, 32 are accommodated into the housing 70 as follows.

That is, as shown in FIG. 5, the first and second tip side terminals 50A, 50B are respectively inserted into the connecting portion 72 of the housing 70 through the insertion opening 72*a* and the tip parts thereof are caused to project out from the projection opening 72*b*. At this time, the corner portions 55 of the first and second tip side terminals 50A, 50B come into contact with the contact portions 74*a*, 75*a* and the locking projections 77*a* of the housing 70 are locked into the locking holes 57, whereby movements of the first and second tip side terminals 50A, 50B in the extending direction Y are restricted.

Subsequently, the first and second base-end side terminals 40A, 40B are respectively inserted into the insertion portion 71 of the housing 70.

Finally, the first and second tip side terminals 50A, 50B are respectively mounted on the first and second base-end side terminals 40A, 40B by the screws 60 through the insertion opening 72*a* of the connecting portion 72.

<Shield Shell 90>

As shown in FIGS. 1 and 2, the housing 70 is covered by the shield shell 90. The shield shell 90 includes a tubular first shield shell 91 for covering the insertion portion 71 of the housing 70 and a second shield shell 94 for covering the connecting portion 72 of the housing 70.

As shown in FIG. 2, the first shield shell 91 has an oval cross-sectional shape long in the arrangement direction X. An insertion hole 91*a* is formed in a surface of the first shield shell 91 on one side in the extending direction Y. The insertion hole 91*a* is formed at a position corresponding to the insert member 82 of the insertion portion 71 of the housing 70. A flange portion 92 is formed on one side (upper side of FIG. 2) in the orthogonal direction Z of the first shield shell 91. A reduced-diameter portion 93 having a smaller diameter than other parts is formed on the other side (lower side of FIG. 2) in the orthogonal direction Z of the first shield shell 91. Note that a braided wire (not shown) formed by braiding conductive strands into a tube is mounted on the reduced-diameter portion 93.

The insertion portion 71 of the housing 70 is covered by the first shield shell 91, whereby the sealing member 81 of the insertion portion 71 is held in close contact with the first shield shell 91.

The second shield shell 94 includes a pair of first side walls 95 for covering both sides in the arrangement direction X of the connecting portion 72 of the housing 70, a second side wall 96 for covering one side in the extending direction Y of the connecting portion 72 and a third side wall 98 for covering a part of the connecting portion 72 on one side in the orthogonal direction Z.

A mounting portion 97 projects toward the other side in the orthogonal direction Z from an edge part of the second side wall 96. The mounting portion 97 is formed with an insertion hole 97*a*. The insertion hole 97*a* is formed at a position corresponding to the insert member 82 of the insertion portion 71 of the housing 70.

The third side wall 98 is formed with an insertion hole 98*a*. The insertion hole 98*a* is formed at a position corresponding to the insert member 83 of the projecting portion 73 of the housing 70. Further, a pair of mounting portions 99 project toward the other side in the extending direction Y from both ends in the arrangement direction X of an edge part of the third side wall 98. Each mounting portion 99 is formed with an insertion hole 99*a*.

With the housing 70 covered by the first and second shield shells 91, 94, the mounting portion 97 of the second shield shell 94 is located outside the first shield shell 91.

The first shield shell 91 and the second side wall 96 of the second shield shell 94 are fixed to the housing 70 by inserting a screw 100 through the insertion hole 97*a* of the second shield shell 94 and the insertion hole 91*a* of the first shield shell 91 and threadably engaging the screw 100 with the insert member 82 of the housing 70. Further, the third side wall 98 of the second shield shell 94 is fixed to the housing 70 by inserting a screw 100 through the insertion hole 98*a* of the second shield shell 94 and threadably engaging the screw 100 with the insert member 83 of the housing 70.

Next, the device 110 is described.

<Device 110>

As shown in FIG. 1, the device 110 includes a terminal block 120 to which the connection terminals 31, 32 of the connector 10 are connected, and a case 160 which is made of a metal material and covers the terminal block 120.

First, the terminal block 120 is described.

As shown in FIG. 6, the terminal block 120 includes a first connecting member 121 and a second connecting member 122 to be respectively electrically connected to the first and second connection terminals 31, 32. The first and second connecting members 121, 122 have the same shape and are in the form of plates extending along the extending direction Y and formed with through holes 123 in tip parts. The first and second connecting members 121, 122 are, for example, made of copper, copper alloy, aluminum, aluminum alloy or the like. Note that the first and second connecting members 121, 122 are equivalent to connecting members according to the present invention.

In this embodiment, the connection terminals 31, 32 come into contact with the connecting members 121, 122 from outside in the orthogonal direction Z and are conductively connected to the connecting members 121, 122 to form two conductive portions 200.

Figure 7:
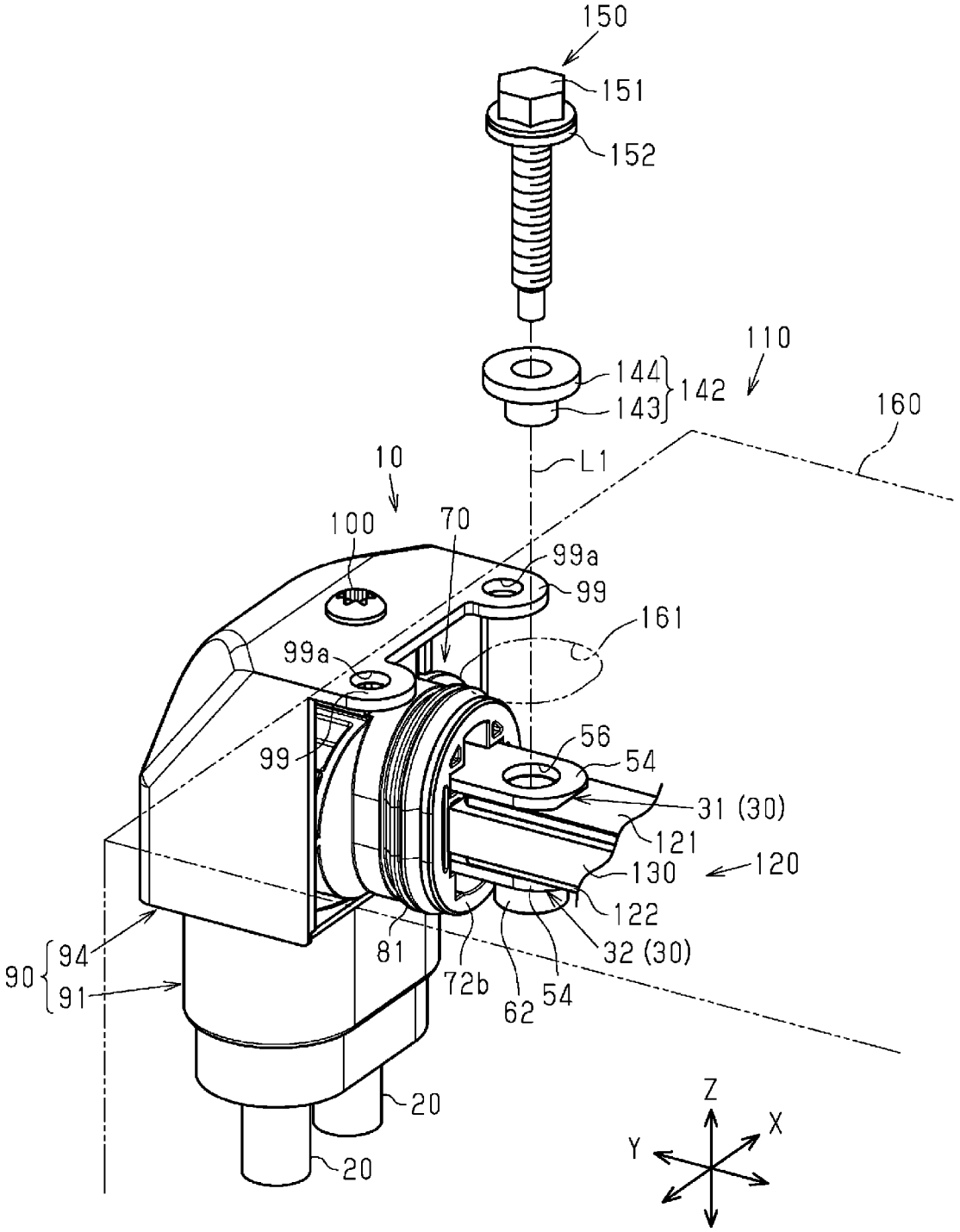
FIG. 7 is an exploded perspective view showing the connector, the device and a second insulator and a bolt of the embodiment separated from each other.

As shown in FIGS. 6 and 7, a spacer 130 made of an insulating resin material is entirely interposed between the first and second connecting members 121, 122 in the extending direction Y. A through hole 131 is formed in a tip part of the spacer 130. The through holes 123 of the first and second connecting members 121, 122 and the through hole 131 of the spacer 130 are located on the same axis L1 in the orthogonal direction Z. Note that a diameter of the through hole 131 of the spacer 130 is larger than those of the respective through holes 123 of the first and second connecting members 121, 122.

A hollow cylindrical first insulator 141 is interposed between the conductive portions 200 inside the through hole 131 of the spacer 130. The first insulator 141 is formed of insulating ceramic such as alumina. Both ends in the orthogonal direction Z of the first insulator 141 are in contact with the connecting members 121, 122. An outer diameter of the first insulator 141 is substantially equal to the diameter of the through hole 131 of the spacer 130. An inner diameter of the first insulator 141 is substantially equal to the diameters of the through holes 123 of the respective connecting members 121, 122.

The connection terminals 31, 32 and the connecting members 121, 122 are collectively fastened by a conductive common bolt 150. The bolt 150 is inserted from the side of the first tip side terminal 50A and threadably engaged with the nut 62 of the second tip side terminal 50B.

A hollow cylindrical second insulator 142 is interposed between a head portion 151 of the bolt 150 and the first tip side terminal 50A, more particularly, between the head portion 151 of the bolt 150 and the tip part of the tip side extending portion 54 of the first tip side terminal 50A. The second insulator 142 is formed of insulating ceramic such as alumina. The second insulator 142 includes an inserting portion 143 and an enlarged-diameter portion 144 having a larger diameter than the inserting portion 143 on one side in the orthogonal direction Z of the inserting portion 143. The inserting portion 143 is inserted into the through hole 56 of the first tip side terminal 50A, the through hole 123 of the first connecting member 121 and the first insulator 141. The enlarged-diameter portion 144 is in contact with a part of the first tip side terminal 50A opposite to the first connecting member 121.

The both conductive portions 200 are insulated from each other by the first insulator 141 and the first tip side terminal 50A and the bolt 150 are insulated from each other by the second insulator 142.

Note that a washer 152 is provided between the head portion 151 of the bolt 150 and the enlarged-diameter portion 144 of the second insulator 142.

As shown in FIGS. 1 and 7, the second shield shell 94 is fixed to the case 160. More particularly, the second shield shell 94 is fixed to the case 160 by bolts (not shown) inserted through the pair of mounting portions 99.

A part of the case 160 corresponding to the respective conductive portions 200 is formed with an opening 161 used to fasten the bolt 150. As shown in FIG. 7, the opening 161 functions as a work opening used to fasten the connector 10 and the device 110 by the bolt 150 via the second insulator 142 inside the case 160.

Functions and Effects of this Embodiment are Described.

(1) The connector 10 includes two connection terminals 30 to be respectively connected to the ends 21 of the two wires 20 extending side by side and including the through holes 50 in the tip parts, and the housing 70 for accommodating the both connection terminals 30 separated from each other with the respective tip parts of the connection terminals 30 caused to project out. The tip parts of the both connection terminals 30 are located at a distance from each other in the orthogonal direction Z, and the through holes 56 of the both connection terminals 30 are located on the same axis L1 along the orthogonal direction Z.

According to this configuration, the both connection terminals 30 are separated from each other and the through holes 50 in the tip parts of the both connection terminals 30 are located on the same axis L1 along the orthogonal direction Z. Thus, when the plurality of connection terminals 30 are bolted to the device 110, to which the connector 10 is connected, the plurality of connection terminals 30 can be collectively fastened by inserting the common bolt 150 through the through holes 56 of the plurality of connection terminals 30. Therefore, a connecting operation to the device 110 is facilitated.

(2) The connection terminals 30 include the first connection terminal 31 and the second connection terminal 32. The first and second connection terminals 31, 32 include the first and second base-end side terminals 40A, 40B to be connected to the ends 21 of the wires 20 and extending along the extending directions of the ends 21 and the first and second tip side terminals 50A, SOB formed with the through holes 56 and to be mounted on the first and second base-end side terminals 40A, 40B. The first and second tip side terminals 50A, SOB have the same shape and are inverted from each other.

According to this configuration, the first tip side terminal 50A of the first connection terminal 31 and the second tip side terminal 50B of the second connection terminal 32 having the same shape are inverted from each other. Thus, common components can be used as the first and second tip side terminals 50A, 50B. Therefore, an increase in the number of components of the connector 10 can be suppressed.

(3) The first and second tip side terminals 50A, 50B are provided with the locking holes 57, and two locking projections 77*a* to be locked into the locking holes 57 of the both tip side terminals 50A, 50B project inside the housing 70.

According to this configuration, since the first and second tip side terminals 50A, 50B can be locked in the housing 70, an operation of respectively mounting the first and second tip side terminals 50A, 50B on the first and second base-end side terminals 40A, 40B by the screws 60 is facilitated.

(4) The connection structure of the connector 10 includes the connector 10 and the device 110 having the two connecting members 121, 122 to which the connection terminals 31, 32 are electrically connected. The connection terminals 31, 32 and the connecting members 121, 122 are collectively fastened by one bolt 150.

According to this configuration, functions and effects similar to the above functions and effects (1) to (3) can be achieved.

Further, since the connection terminals 31, 32 and the connecting members 121, 122 can be collectively fastened by one bolt 150, the opening 161 of the case 160 can be made smaller.

(5) The connection terminals 31, 32 and the connecting members 121, 122 come into contact with and are conductively connected to each other in the orthogonal direction Z to form the plurality of conductive portions 200, and the first insulator 141 made of insulating ceramic is interposed between the plurality of conductive portions 200 in the orthogonal direction Z. The second insulator 142 made of insulating ceramic is interposed between the first connection terminal 31 and the head portion 151 of the conductive bolt 150.

According to this configuration, the conductive portions 200 are insulated from each other by the first insulator 141, and the first connection terminal 31 and the head portion 151 of the bolt 150 are insulated from each other by the second insulator 142. Here, since being made of ceramic, each insulator 141, 142 is hardly deformed by a fastening force at the time of fastening the bolt 150. Further, as the bolt 150 is fastened, a pressing force is applied to each conductive portion 200 in the orthogonal direction Z by the adjacent insulator 141, 142. This makes a conductive state in each conductive portion 200 satisfactory. Therefore, the both conductive portions 200 can be suitably collectively fastened by the bolt 150 while insulation between the both conductive portions 200 is ensured.

This embodiment can be modified and carried out as follows. This embodiment and the following modifications can be carried out in combination with each other without technically contradicting each other.

The first and second insulators 141, 142 only have to be able to insulate the both conductive portions 200 from each other and are not limited to those made of alumina. For example, oxide-based ceramics such as zirconia, yttria, mullite and cordierite or non-oxide-based ceramics such as silicon nitride and aluminum nitride may be used. Further, a composite material obtained by combining another material with a certain ceramic may be used.

Here, as the bolt 150 is fastened, a pressing force is applied to the first and second insulators 141, 142 in the orthogonal direction Z. Thus, for example, silicon nitride, zirconia and alumina can be suitably used since being tougher than yttria.

The first and second insulators 141, 142 may be made of mutually different types of ceramics.

Although the conductive portions 200 of this embodiment are formed by the connection terminals 31, 32 contacting the connecting members 121, 122 from outside in the orthogonal direction Z, the connection terminals 31, 32 may contact the connecting members 121, 122 from inside in the orthogonal direction Z. In this case, an insulator may be interposed between the two connection terminals 31 and 32.

The bolt 150 may be a bolt having no conductivity. In this case, the second insulator 142 can be omitted.

The locking holes 57 of the first and second tip side terminals 50A, 50B and the arm portions 77 and the locking projections 77*a* of the housing 70 can be omitted.

The corner portions 55 of the first and second tip side terminals 50A, SOB and the contact portions 74*a*, 75*a* of the housing 70 can be omitted.

The present invention can be applied also to a connector including connection terminals in which base-end side terminals and tip side terminals are integrally formed. In this case, the connection terminals may extend straight along the extending direction (orthogonal direction Z) of the ends 21 of the wires 20 without being limited to the bent ones.

The first and second tip side terminals 50A, SOB may not have the same shape.

The second tip side terminal SOB and the nut 62 may be joined in a method different from press-fitting such as joining via adhesive or joining by welding.

The second tip side terminal SOB and the nut 62 may be joined after the second tip side terminal SOB is inserted into the second accommodating portion 75 of the housing 70. In this case, the escaping portion 78 of the housing 70 can be omitted.

The first and second connecting members 121, 122 may not have the same shape.

The present invention can be applied also to a connector including three or more connection terminals. Also in this case, the connection terminals may be so provided that through holes thereof are located on the same axis along the orthogonal direction Z. Further, in the case of connecting this connector to a device, the second insulators 142 may be interposed between the conductive portions 200. If connection terminals including the connection terminals 31, 32 of this embodiment are used in this configuration, functions and effects similar to the above functions and effects (2) can be achieved.

The arrangement direction Z and the extending direction Y may not be orthogonal.

Although an example of the connector 10 having the arrangement direction X, the extending direction Y and the orthogonal direction Z orthogonal to each other has been described in this embodiment, the term "orthogonal" means not only strictly orthogonal, but also substantially orthogonal within a range in which the functions and effects in this embodiment are achieved.

The postures of the connector 10 and the device 110 are not limited to those of this embodiment and can be changed as appropriate.

The present disclosure includes the following implementation examples. Reference signs of typical constituent elements of the embodiment are added not for limitation, but for understanding assistance.

[Addendum 1] One or more of implementation examples of the present disclosure may be directed to a connector (10) for connecting a plurality of wires (20) to a device (110), the connector (10) including:

a plurality of wires (20) having a plurality of conductive cores, the plurality of conductive cores having a plurality of ends (21) arranged in parallel on a first plane (e.g. ZX plane); and a plurality of metal fittings (40A, 40B, 50A, SOB) respectively fixed to the plurality of ends (21) of the plurality of conductive cores, wherein:

the plurality of metal fittings (40A, 40B, 50A, SOB) respectively include a plurality of tip side flat plate portions (54) extending in parallel to a second plane (e.g. XY plane) intersecting the first plane (ZX plane) and extending in parallel at a distance from each other, and the plurality of tip side flat plate portion (54) respectively include a plurality of bolt holes (56) and the plurality of bolt holes (56) of the plurality of tip side flat plate portions (54) are aligned on a common single axis (L1) perpendicular to the second plane (e.g. XY plane).

[Addendum 2] Several implementation examples of the present disclosure may include a single bolt (150) to be inserted through the plurality of bolt holes (56) of the plurality of tip side flat plate portions (54).

[Addendum 3] In several implementation examples of the present disclosure, the bolt (150) may be configured to fasten the plurality of tip side flat plate portions (54), a plurality of conductive connecting members (121, 122) of the device (110) and a tubular insulating spacer (130) with the plurality of conductive connecting members (121, 122) sandwiched in a clearance between the plurality of tip side flat plate portions (54) and the tubular insulating spacer (130) sandwiched between the plurality of conductive connecting members (121, 122) of the device (110).

[Addendum 4] In several implementation examples of the present disclosure, each metal fitting (40A, 40B, 50A, 50B) may further include a base-end side flat plate portions (42) extending in parallel to the first plane (e.g. ZX plane) and be bent between the base-end side flat plate portions (42) and the tip side flat plate portion (54).

[Addendum 5] In several implementation examples of the present disclosure, each metal fitting (40A, 40B, 50A, 50B) may include a base-end side terminal (40A, 40B) having the base-end side flat plate portion (42), a tip side terminal (50A, 50B) having the tip side flat plate portion (54), and a conductive connecting member (60) for mechanically and electrically connecting the base-end side terminal (40A, 40B) and the tip side terminal (50A, 50B).

[Addendum 6] In several implementation examples of the present disclosure, the plurality of base-end side terminals (40A, 40B) of the plurality of metal fittings (40A, 40B, 50A, 50B) may include a plurality of barrel portions (41) to be crimped to the plurality of ends (21) of the conductive cores.

[Addendum 7] In several implementation examples of the present disclosure, the connector (10) may be an L-shaped connector.

It would be apparent to a person skilled in the art that the present invention may be embodied in other specific forms without departing from the technical concept thereof. For example, some of the components described in the embodiment (or one or more modes thereof) may be omitted or several components may be combined. The scope of the present invention should be determined together with the full range of equivalents, to which claims are entitled, by reference to appended claims.

LIST OF REFERENCE NUMERALS

10 . . . connector, 20 . . . wire, 21 . . . end, 30 . . . connection terminal, 31 . . . first connection terminal, 32 . . . second connection terminal, 40A . . . first base-end side terminal, 40B . . . second base-end side terminal, 41 . . . crimping portion, 42 . . . base-end side extending portion, 43 . . . through hole, 50A . . . first tip side terminal, 50B . . . second tip side terminal, 51 . . . fixing portion, 52 . . . through hole, 53 . . . bent portion, 54 . . . tip side extending portion, 55 . . . corner portion, 56 . . . through hole, 57 . . . locking hole, 60 . . . screw, 61 . . . nut, 62 . . . nut, 70 . . . housing, 71 . . . insertion portion, 72 . . . connecting portion, 72*a* . . . insertion opening, 72*b* . . . projection opening, 73 . . . projecting portion, 74 . . . first accommodating portion, 74*a* . . . first contact portion, 75 . . . second accommodating portion, 75*a* . . . second contact portion, 76 . . . separation wall, 77 . . . arm portion, 77*a* . . . locking projection, 78 . . . escaping portion, 80 . . . cap, 81 . . . sealing member, 82 . . . insert member, 83 . . . insert member, 90 . . . shield shell, 91 . . . first shield shell, 91*a* . . . insertion hole, 92 . . . flange portion, 93 . . . reduced-diameter portion, 94 . . . second shield shell, 95 . . . first side wall, 96 . . . second side wall, 97 . . . mounting portion, 97*a* . . . insertion hole, 98 . . . third side wall, 98*a* . . . insertion hole, 99 . . . mounting portion, 99*a* . . . insertion hole, 100 . . . screw, 110 . . . device, 120 . . . terminal block, 121 . . . first connecting member, 122 . . . second connecting member, 123 . . . through hole, 130 . . . spacer, 131 . . . through hole, 141 . . . first insulator, 142 . . . second insulator, 143 . . . inserting portion, 144 . . . enlarged-diameter portion, 150 . . . bolt, 151 . . . head portion, 152 . . . washer, 160 . . . case, 161 . . . opening, 200 . . . conductive portion

What is claimed is:

1. A connector, comprising:

a plurality of connection terminals to be respectively connected to ends of a plurality of wires extending side by side, the plurality of connection terminals including through holes in tip parts; and a housing for accommodating the plurality of connection terminals separated from each other with the respective tip parts caused to project out, wherein the tip parts of the plurality of connection terminals are located at a distance from each other in an orthogonal direction orthogonal to both an arrangement direction of the wires and an extending direction of the tip parts, and the through holes of the plurality of connection terminals are located on the same axis along the orthogonal direction.

2. The connector of claim 1, wherein:

the plurality of connection terminals include a first connection terminal and a second connection terminal, the first and second connection terminals include a first base-end side terminal and a second base-end side terminal to be connected to the ends of the wires and extending along the extending direction of the ends and a first tip side terminal and a second tip side terminal formed with the through holes and to be mounted on the first and second base-end side terminals, and the first and second tip side terminals have the same shape and are inverted from each other.

3. The connector of claim 1, wherein:

the plurality of connection terminals are provided with locking holes, and a plurality of locking projections to be respectively locked into the locking holes of the plurality of connection terminals project inside the housing.

4. A connector connection structure, comprising:

a connector, including:

a plurality of connection terminals to be respectively connected to ends of a plurality of wires extending side by side, the plurality of connection terminals including through holes in tip parts; and a housing for accommodating the plurality of connection terminals separated from each other with the respective tip parts caused to project out; and a device including a plurality of connecting members to be electrically connected to the plurality of connection terminals, wherein the tip parts of the plurality of connection terminals are located at a distance from each other in an orthogonal direction orthogonal to both an arrangement direction of the wires and an extending direction of the tip parts, and the through holes of the plurality of connection terminals are located on the same axis along the orthogonal direction, and the plurality of connection terminals and the plurality of connecting members are collectively fastened by one bolt.

5. The connector connection structure of claim 4, wherein:

the bolt is conductive, the plurality of connection terminals and the plurality of connecting members come into contact with and are conductively connected to each other in the orthogonal direction to form a plurality of conductive portions, and a first insulator made of insulating ceramic is interposed between the plurality of conductive portions in the orthogonal direction, and a second insulator made of insulating ceramic is interposed between the outermost conductive portion in the orthogonal direction, out of the plurality of conductive portions, and a head portion of the bolt.

* * * * *